US005652962A

United States Patent [19]

Patnode

[11] Patent Number: 5,652,962

[45] Date of Patent: Aug. 5, 1997

[54] PATIENT COMFORT GOWN ASSEMBLY

[76] Inventor: Shirley Patnode, 5406 W. Lincoln Ave., Yakima, Wash. 98908

[21] Appl. No.: 660,796

[22] Filed: Jun. 6, 1996

[51] Int. Cl.[6] ..... A41D 13/00

[52] U.S. Cl. ..... 2/114; 2/105; 2/125; 2/158

[58] Field of Search ..... 2/46, 69, 67.5, 2/75, 80, 83, 59, 60, 105, 106, 128, 126, 114, 115, 158, 49.1, 48, 49.2, 49.3, 49.4, 49.5, 50, 51, 52

[56] References Cited

U.S. PATENT DOCUMENTS

| | | | |
|---|---|---|---|
| 1,462,515 | 7/1923 | McElroy | 2/114 |
| 1,489,046 | 4/1924 | Thompson | 2/114 |
| 2,030,091 | 2/1936 | Behrunger | 2/114 |
| 2,166,727 | 7/1939 | Mott | 2/83 |
| 2,374,643 | 5/1945 | Boettcher | 2/114 |
| 2,469,556 | 5/1949 | Jacobson | 2/69.5 |
| 3,129,432 | 4/1964 | Belkin | 2/114 |
| 4,308,622 | 1/1982 | Maddron | 2/125 X |
| 4,422,186 | 12/1983 | Loney | 2/114 |
| 4,570,268 | 2/1986 | Freeman | 2/114 |
| 4,787,101 | 11/1988 | Feinburg | 2/114 X |
| 4,977,622 | 12/1990 | Schley | 2/59 |

*Primary Examiner*—Jeanette E. Chapman

*Attorney, Agent, or Firm*—Donald E. Nist

[57] ABSTRACT

The gown assembly of the present invention is constructed to provide a patient wearing the gown with maximum comfort and also ease of insertion of various intravenous tubes for feeding and blood sampling without removal of the gown. Moreover, the gown is adapted to fit a variety of sizes and shapes of patients and has patient-restraining straps and bands integral with the gown. The gown preferably is of washeable cloth and may be disposable. The gown extends from about the level of the neck to at least about the level of the knees and opens at the back by means of a vertical opening extending the full length thereof and placed off the midline of the gown so that the fasteners for the gown will not rub the spinal column. The gown includes mittens attached to the ends of the sleeves and having elongated restraining bands which tie into bows. The sleeves have transverse openings extending from the inner margin thereof at the level of the elbow to about the outer margin thereof for insertion of intravenous tubes and for ease of bending the arms. The sleeves have full length closeable openings for insertion of intravenous tubes. The upper surfaces of the mittens can include closeable openings which extend at an angle from the inner to the outer margins thereof for insertion of intravenous tubes. The rear of the gown has a transverse reinforcing strip and an elongated cinching and restraining strap preferably releasably connected thereto.

10 Claims, 1 Drawing Sheet

PATIENT COMFORT GOWN ASSEMBLY

BACKGROUND OF THE INVENTION

1. Field of the Invention

The present invention generally relates to wearing apparel and more particularly to an improved patient gown which provides improved comfort, patient restraint and ease of insertion of intravenous tubes and other medical equipment therethrough.

2. Prior Art

Various types of patient gowns have been provided in the past. Most such gowns extend down from the neck to below the knees and have short sleeves. They are donned either by dropping them down through a head opening or by fitting them around the patient and tying the rear portions together with straps, bands or the like. Most such gowns have no integral patient restraining means, such as are needed with patients having certain types of maladies, for example, patients with advanced psychoses and those sufficiently enfeebled, as by Alzheimer's disease and the like, to be unable to care for themselves.

Moreover, when it is necessary for an intravenous tube or the like to be placed in the patient's arm at a level concealed by the gown, the gown must be pushed up out of the way. This can be uncomfortable for the patient and inconvenient for the medical attender and may interfere with the proper use of the intravenous tube.

Certain types of hospital patient gowns have been constructed to address some of the above-described problems. See, for example, U.S. Pat. No. 4,977,622 which discloses a patient gown having full length removeable sleeves which open from the lower end for easier use of intravenous tubes and the like. That gown, however, does not have patient restraining means. U.S. Pat. No. 4,422,186 discloses a short sleeved hospital gown which has an opening in the upper outer margin of each sleeve to facilitate donning the gown and the use of intravenous tubes, but which also is devoid of patient restraining means.

One of the problems not addressed by conventional hospital gowns is the protection of the patient and restraining of the patient against the destructive use of his or her hands, as in picking at the skin, removing intravenous tubes, breathing assisting equipment and the like and in damaging other hospital equipment.

Accordingly, there remains a need for an improved type of patient gown which affords the patient greater wearing comfort and which protects the patient against destructive acts while permitting full access to the patient for blood sampling, intravenous feeding of nutrients, antibiotics and other medications and for the application of other medical procedures to aid the patient.

Such gown should have full patient restraining means integral with the gown so as to be available for instant deployment when needed. Preferably, the gown should be washeable for reuse and/or readily disposeable. Moreover, the gown should be relatively simple and inexpensive to make and replace and should be capable of being used in a variety of modes.

SUMMARY OF THE INVENTION

The improved patient comfort gown assembly of the present invention satisfies all the foregoing needs. The gown assembly is substantially as set forth in the ABSTRACT OF THE DISCLOSURE.

Thus, the gown assembly comprises a patient gown of flexible resilient material such as cloth or .the like, which preferably is washeable and easily disposable. The assembly is simple to construct, inexpensive and easy to use.

The gown of the assembly has a number of novel features which contribute to its improved comfort when worn and to its improved utility. Thus, it features patient restraining means of an improved type and also facilitates easier access to the patient for the purpose of inserting intravenous tubes and for running various tests, such as taking blood samples, performing skin patch tests and the like.

The gown extends from about the level of the neck to at least about the level of the knees and is essentially one piece in construction. It includes full length sleeves to the lower ends of which are attached, preferably permanently, a pair of mittens to cover the hands of the patient. The gown has a full front and sides and a back which is split by a vertical opening extending from the top to the bottom of the gown but is offset from the centerline of the back so that closure means for the opening do not rub or otherwise impinge on the spine of the patient when the patient is lying or sitting. This improves the comfort of the gown.

Each sleeve of the gown has an opening on the outer margin thereof and extending from about the level of the shoulder down to the lower end of the sleeve for easy access of the entire arm for intravenous tubes and the like. That opening is releasably closed by a closure which may be similar to those employed at the back of the gown. For example, an elongated pair of strips may be used for each closure, one of the pair bearing hooks spaced along the length thereof and the other of the pair bearing hook-receiving loops spaced along the length thereof. Such strips preferably are of flexible cloth and are firmly connected to the gown.

Each sleeve also has a transverse opening at about the level of the elbow and extending from the inner margin to about the outer margin thereof but not intersecting the previously described sleeve openings. If desired, the transverse openings can be releasably closed, as by means such as those just described. The transverse openings further facilitate access to the arms of the patient for intravenous tubes, etc., also increase the comfort and flexibility of the arms while in the sleeves, and, if desired, can intersect the sleeve openings.

A pair of mittens which preferably fully enclose the patient's hands are connected, preferably permanently, to the lower ends of the sleeves. This protects the patient from destructive acts, such as skin picking and the like. The mittens include restraining means in the form of elongated ribbons connected to the outer surface of the mittens. The ribbons can be used to tie the patient's hands to the sides of a bed or chair. Preferably, each ribbon has two free ends and can be tied into a bow to keep it out of the way when not in use.

In one embodiment of the invention, each mitten has on the upper surface thereof an elongated opening or slot closeable by a pair of strips bearing hooks and hook-receiving loops, as previously described, or other closure means. The slot preferably runs at an angle from the inner margin of the mitten adjacent the wrist to the area of the base of the little finger. The slot offers access to the hand through the mitten for blood sampling, insertion of an intravenous tube, etc.

Cinching and restraining means form part of the assembly and comprise an elongated flexible strap disposed transversely at about waist level at the rear of the gown and extending outwardly therefrom for either cinching the gown tightly around the patient or for restraining the patient by connecting opposite ends of the strap to, for example, the sides of a bed or chair. Preferably, the strap is removeable from the gown and passes through one or more loops at the rear of the gown. Also preferably, in order to give the gown greater strength when utilized in a restraining mode, the waist of the gown at the back thereof has a transverse band of reinforcing material, such as high strength cloth, anchored in the gown and forming the base for the one or more strap loops referred to above.

Various other features of the improved patient comfort gown assembly of the present invention are set forth in the following detailed description and accompanying drawings.

DRAWINGS

DETAILED DESCRIPTION

Figure 2:
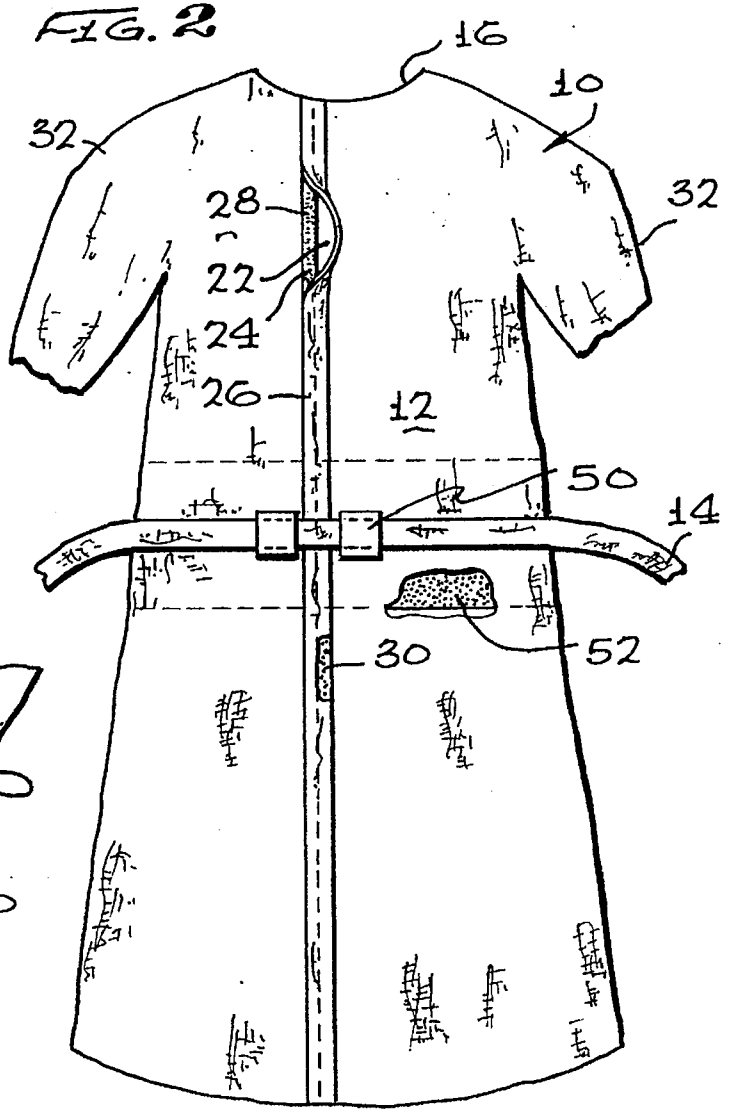
FIG. 2 is a schematic fragmentary rear elevation, partly broken away, of the comfort gown assembly of FIG. 1, showing the transverse restraining strap of the assembly; and, FIG. 3 is a schematic top plan view, partly broken away, of a modified form of the hand mitten used in the comfort gown assembly of FIGS. 1 and 2.
Figure 1:
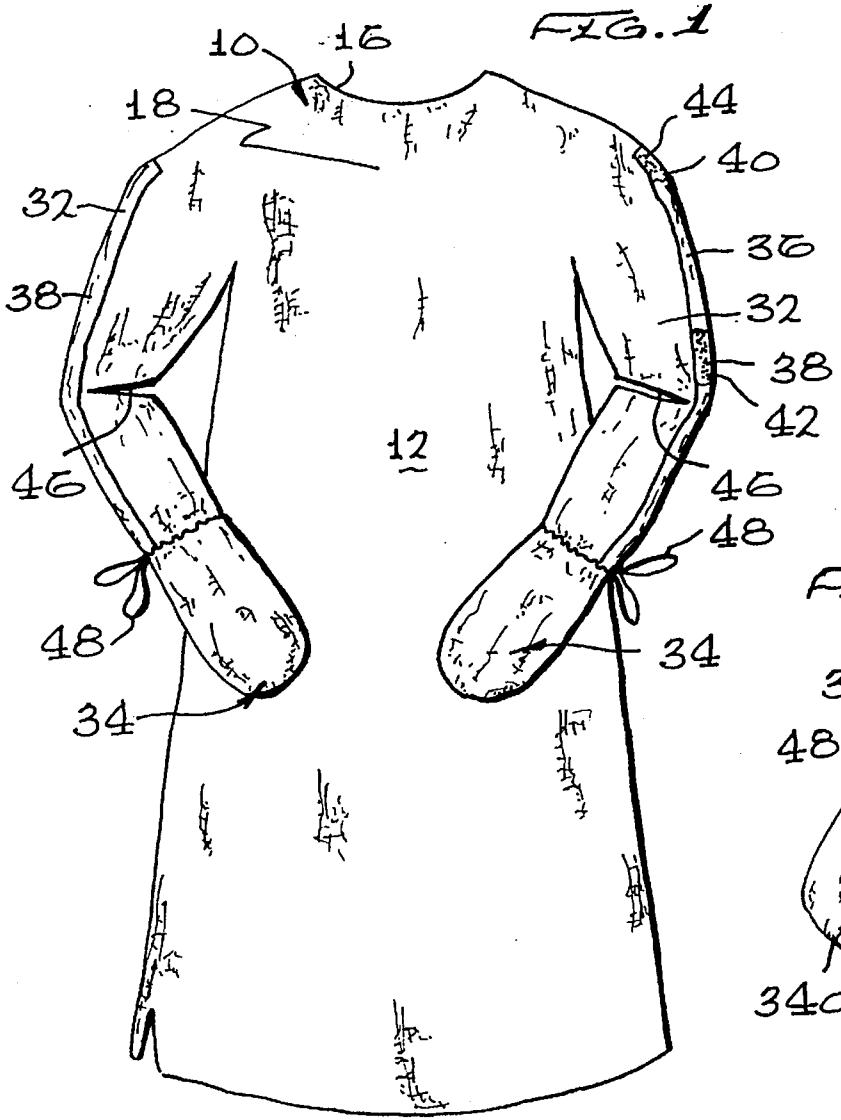
FIG. 1 is a schematic front elevation, partly broken away, of a preferred embodiment of the improved patient comfort gown assembly of the present invention, minus the'strap shown in FIG. 2.

FIGS. 1 and 2

Now referring more particularly to FIGS. 1 and 2 of the drawings, a preferred embodiment of the improved comfort gown assembly of the present invention is schematically depicted therein. Thus, assembly 10 is shown which comprises an improved gown 12 to which is connected an elongated, flexible, resilient transverse restraining strap 14 of cloth, leather, synthetic plastic webbing or the like.

Gown 12 is flexible and resilient and preferably is formed of washeable and readily disposable material such as cloth of cotton, synthetic fiber such as polyester or the like, or a combination thereof. Other suitable materials can be used.

Gown 12 preferably extends from about the level of the neck to at least about the level of the knees, and has a head opening 16. Preferably, gown 12 has a full front 18 which is unopenable and a rear 20 connected to front 18 by integral sides (not shown). Rear 20 is divided vertically by an opening 22 extending from the upper end thereof to the lower end thereof, which opening 22 is closeable by closure means preferably in the form of a pair of elongated flexible strips 24 and 26 bordering opening 22, permanently connected to gown 12 and overlappable with each other to close opening 22. Strip 24 has a plurality of minute hooks 28 disposed along the length thereof on the upper or exposed surface thereof while strip 26 has a plurality of hook-receiving loops 30 disposed along the length thereof on the lower surface thereof facing hooks 28. Thus, strip 26 can releasably overlap strip 24 to releasably seal opening 22, holding the rear 20 of gown 12 closed.

It will be noted that opening 20 and strips 24 and 26 are off to one side of the centerline of rear 20 of gown 12 so that when gown 12 is closed strips 24 and 26 cannot dig into or rub against the spine of the patient in gown 12. Many patients have little muscle and fat covering the spine and therefore this is a tender area, easily irritated. The closure arrangement of gown 12 therefore promotes patient comfort.

Gown 12 has full length sleeves 32 connected, preferably permanently, at their lower ends to mittens 34. The outer margins of sleeves 32 from about the level of the shoulder down to the lower ends thereof have an opening 36 therein which is releasably closed by closure means, preferably a pair of strips 38 and 40 bordering opening 36 and similar to strips 24 and 26 and bearing hooks 42 and hook-receiving loops 44 similar to hooks 28 and loops 30. Openings 36 permit ready access to the arms of the patient while still in gown 12, so that intravenous tubing and the like can be inserted through gown 12 into the patient's arm(s).

In addition to openings 36, each sleeve 32 has a transverse slot 46 therein extending at about the level of the elbow from the inner margin of sleeve 32 to about opening 36 but without intersecting opening 36. If desired, slot 46 can intersect opening 36.

Although not shown, slot 46 can be closeable by any suitable means, for example, a hook and loop array such as previously described. Slot 46 offers easy access to the patient's arm at about the elbow area for intravenous injection, etc. and also increases the mobility of sleeve 32.

Mittens 34 include hand-restraining ribbons 48 connected to the outer surface thereof, each ribbon 48 having two long free ends and being adapted to be tied into a bow when not in use. When it is desired to restrain a patient's hands, ribbons 48 can be tied to the sides of a bed or chair, etc.

Restraining strap 14 of gown assembly 10 is sufficiently long to enable its opposite ends to be tied to the sides of a bed or chair to forcefully and effectively restrain a patient wearing gown 12. Strap is connected to the rear or back 20 of gown 12 at about the level of the waist and extends transversely therealong, projecting laterally outwardly therefrom. Preferably, the connection of strap 14 to gown 12 is releasable. For such purposes, gown 12 at the back is preferably provided with one or more integral strap loops 50 which preferably are secured to a reinforcing strip 52 of thick cloth or the like secured to gown 12 at the rear waist thereof and extending transversely, as shown in FIG. 2. Reinforcing strip 52 can be, for example, rubberized cloth or the like.

Accordingly, gown 12 is easy to put on and take off, is durable and effective to restrain a patient when needed, since it bears body-restraining strap 14, hand-restraining ribbons 48 and protective mittens 34 and provides improved comfort due to the offset rear closure and the transverse sleeve slot 46, as well as mittens 34. Moreover, slots 46 and openings 36 provide improved access to the patient for injections, etc. while keeping the patient fully covered. Therefore, assembly 10 is improved over the art.

FIG. 3

Figure 3:
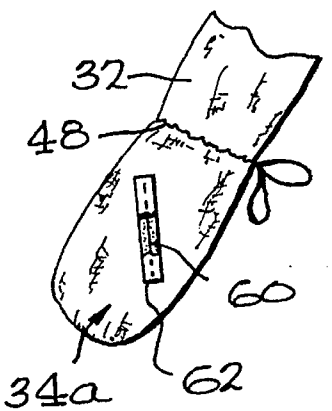

A modified version of the mittens of the gown assembly of the present invention is shown in FIG. 3. Thus, one of two mittens **34*a* is shown. Mittens 34*a* differ from mittens 34 only as follows: Mittens 34*a* have a slit 60 in the upper surface thereof which slit 60 provides easy access to the upper surface of the patient's hand when it is in mitten 34*a*. Slit 60 can be closed in any suitable manner, as by a hook and hook-receiving loop array 62, such as previously described, and secured to mitten 34*a*. Preferably, slit 60 extends from about the inner margin of the upper surface of mitten 34*a* at about the level of the wrist and then forwardly at an angle to a point adjacent the base of the little finger when the patient's hand is in mitten 34*a*. This provides the greatest possible access to the areas on the back of the hand most likely to be contacted for removal of blood samples, injections and insertion of intravenous tubes. Mittens 34*a* have the other advantages of mittens 34 and can be substituted therefor in assembly 10**.

Various other modifications, changes, alterations and additions can be made in the improved comfort gown assembly of the present invention, its components and their parameters. All such modifications, changes, alterations and additions as are within the scope of the appended claims form part of the present invention.

What is claimed is:

1. An improved patient comfort gown assembly, said gown assembly comprising, in combination:

a) a flexible resilient gown dimensioned to cover a patient from about the neck to at least about the level of the knees, said gown including 1) full length sleeves having hand mittens connected to a lower end thereof, an outer margin of each said sleeve from about the level of the shoulder to said mittens defining a first opening adapted for the insertion of intravenous tubes into the patient wearing the gown and releasably closed by closure means connected to said gown, said gown also defining a transverse second opening on each said sleeve for needle injection into the patient's arm, said transverse opening extending from an inner margin of the sleeve at about the level of the elbow of the patient to adjacent said first opening, said second opening facilitating bending of the arm in said gown, 2) a closeable rear opening extending from an upper end of the back of said gown to a lower end thereof, said opening being generally vertical but positioned to one side of the midline of said gown, said gown having closure means for said generally vertical rear opening;

b) an elongated cinching and restraining strap connected to a rear back of said gown at about the waist area thereof for cinching said gown around a patient and for restraining the patient to a bed or chair when needed; and, c) a transverse reinforcing strip connected to said rear of said gown at about the level of the waist of the gown, said reinforcing strip defining at least one loop for said strap.

2. The improved gown assembly of claim 1 wherein said gown also includes flexible elongated hand restraining bands connected to said mittens.

3. The improved gown assembly of claim 2 wherein said gown comprises cloth and wherein said first opening and rear opening closure means comprise elongated pairs of flexible strips connected to said gown, one of said closure strips of each said pair bearing a plurality of hooks disposed along a length of said first opening and said rear opening and the other of said strips of each said pair bearing a plurality of hook-receiving loops disposed along said another length of said first opening and said rear opening.

4. The improved gown assembly of claim 3 wherein said strap is relasably secured to said rear of said gown and wherein said mittens are permanently secured to said sleeves.

5. The improved gown assembly of claim 1 wherein each of said mittens has a pair of said bands releasably tied into bows.

6. The improved gown assembly of claim 1 wherein each said mitten has a closeable opening on the upper surface thereof for insertion of an intravenous tube into an upper surface of a patient's hand when in said mitten and wherein said opening is releasably closed by closure means secured to said mittens.

7. The improved gown assembly of claim 6 wherein said mitten closure means for each said mitten comprise a pair of flexible elongated mating strips, one of said pair of mitten closure strips having a plurality of hooks disposed along a length of said closeable opening and the other of said mitten closure strips of said pair having a plurality of hook-receiving loops disposed along said length of said closeable opening.

8. The improved gown assembly of claim 7 wherein said mitten opening extends at an angle from about the medial side margin of said mitten upper surface at about the wrist area to about the lateral side margin of said mitten upper surface at about the base of the little finger of a patient when wearing said mitten.

9. The improved gown assembly of claim 1 wherein said assembly comprises washeable cloth.

10. The improved gown assembly of claim 1 wherein said assembly comprises disposeable cloth.

* * * * *